US005778466A

United States Patent [19]

Price

[11] Patent Number: 5,778,466

[45] Date of Patent: Jul. 14, 1998

[54] BOX SPRING ASSEMBLY WITH CROSS SLATS OF DIFFERENT HEIGHTS

[76] Inventor: J. Wesner Price, Rte. 2, Box 18, Cameron, S.C. 29030

[21] Appl. No.: 857,064

[22] Filed: May 15, 1997

[51] Int. Cl.[6] ..... A47C 23/00

[52] U.S. Cl. ..... 5/247; 5/727

[58] Field of Search ..... 5/246, 247, 248, 5/719, 716, 727, 255; 267/103, 100

[56] References Cited

U.S. PATENT DOCUMENTS

| | | | |
|---|---|---|---|
| 97,306 | 11/1869 | Manuel | 5/264.1 |
| 1,059,080 | 4/1913 | Shoemaker . | |
| 1,371,362 | 3/1921 | Gese | 5/727 |
| 1,933,843 | 11/1933 | Cane | 5/264.1 |
| 3,080,576 | 3/1963 | Cervisi | 5/264.1 |
| 3,626,523 | 12/1971 | Robins | 5/727 |
| 3,825,960 | 7/1974 | Inman et al. | 5/247 |
| 4,074,372 | 2/1978 | Schulz, Jr. | 5/239 |
| 4,120,058 | 10/1978 | Kitchen et al. | 5/247 |
| 4,222,137 | 9/1980 | Usami | 5/727 |
| 4,679,266 | 7/1987 | Kraft | 5/727 |

*Primary Examiner*—Alexander Grosz
*Attorney, Agent, or Firm*—Dority & Manning

[57] ABSTRACT

An improved box spring assembly is selectively reinforced to reduce sagging. The box spring assembly includes a bottom frame with end rails and side rails and a series of cross slats lying across the frame. The box spring assembly incorporates a combination of conventional flat cross slats and reinforcing cross slats, each supporting a number of spring modules of complementary height, giving the box spring uniform height throughout. The spring modules are attached to a grid top, and the grid top and spring modules are enclosed by a fabric cover. By using reinforced cross slats in locations where extra strength is needed and conventional cross slats elsewhere, the improved box spring assembly reduces sagging that could otherwise occur, without incurring the extra cost and weight of using reinforcing cross slats throughout.

8 Claims, 4 Drawing Sheets

BOX SPRING ASSEMBLY WITH CROSS SLATS OF DIFFERENT HEIGHTS

BACKGROUND OF THE INVENTION

The present invention relates to an improved design for the construction of a box spring assembly. More particularly, the invention relates to a box spring assembly which is selectively reinforced to reduce sagging with could otherwise occur.

A conventional box spring is constructed having a wooden rectangular frame with a pair of parallel side rails across which a plurality of cross slats transversely extend. The cross slats support the wire springs contained in the box spring. The box spring will usually have a vertical height approximately the same as the mattress it will support.

Box spring structures have been designed using low profile spring modules in special applications where it is desired to have a relatively thin vertical height. Low profile springs have a shorter vertical height than conventional springs, thus yielding a box spring assembly which itself has a smaller vertical height. In some cases, cross slats have been mounted on raised side rails, or the spring modules have been supported on an intermediate frame, to allow the use of low profile springs while achieving a conventional vertical height for the overall box spring.

As illustrated in FIG. 5, a conventional box spring assembly 1 is generally designed with a plurality of cross slats, such as cross slats 3, lying flat across a frame structure 5. A plurality of conventional torsion springs, such as springs 7, are attached to the cross slats at their respective lower ends. The springs are secured together at their upper ends by a grid top 9. As can be seen, the resulting box spring structure has a conventional vertical height H.

Using this design, the downward directed weight of a person lying on box spring assembly 1 and the overlying mattress can cause the cross slats to weaken and break with extended use, resulting over time in sagging of the box spring and mattress. Attempts to alleviate this problem have included using transverse supports on the bed frame itself, and varying the orientation of the cross slats to increase their strength. Prior art teaches the use of oblong cross slats, all resting on the side rails of the frame with their greatest cross-sectional dimension extending vertically.

SUMMARY OF THE INVENTION

The present invention recognizes and addresses the various disadvantages of prior art construction and methods. Accordingly, it is an object of the present invention to provide an improved design for the construction of a box spring assembly.

More particularly, it is an object of the present invention to provide a box spring assembly with enhanced load-bearing capacity only in selected areas subject to greater weight load.

It is also an object of the present invention to lessen the occurrence breakage or failure of the cross slats and sagging of the box spring frame and the overlying mattress.

It is an additional object of the present invention to reduce the need for transverse supports on the bed frame itself.

It is a still further object of the present invention to provide a box spring assembly with a reinforced frame, without substantially increasing weight or cost.

It is a still further object of the present invention to provide a box spring assembly of uniform standard height which utilizes a combination of conventional and low profile spring modules.

Additional objects and advantages of the invention will be set forth in part in the following description, or may be obvious from the description, or may be learned through practice of the invention.

Some of these objects are achieved by a box spring assembly having a predetermined vertical height. The box spring assembly comprises a rectangular bottom frame including a pair of parallel side rails, and a pair of parallel end rails respectively positioned at opposite ends of the side rails. A series of cross slats, supported by the side rails, are positioned between and parallel to the end rails a predetermined distance apart.

The cross slats of the box spring assembly include a plurality of first cross slats having a first height, and a plurality of second cross slats having a second height greater than the first height. A plurality of first spring members are mounted on each of the first cross slats and have a third height generally complementary to the first height to provide the predetermined vertical extent. A plurality of second spring members are mounted on each of the second cross slats and have a fourth height generally complementary to the second height to provide the predetermined vertical height. The first spring members and second spring members may each be configured as torsion springs.

In some exemplary embodiments, at least two of the second cross slats are located in two innermost adjacent positions on the bottom frame. For example, four second cross slats may be located in four innermost adjacent positions on the bottom frame, with the first cross slats being located in remaining positions on the bottom frame. Alternatively, one additional second cross slat may be located on each side of the two second cross slats, in a position separated therefrom by one first cross slat.

In some exemplary embodiments, the box spring assembly further comprises a grid top. Each of the first and second spring members are preferably attached to the grid top. In addition, each of the spring members is preferably attached to an associated cross slat using securement means. At least one center slat, located between and generally parallel to the side rails, may extend below the cross slats.

Other objects of the invention are achieved by a box spring assembly comprising a grid top and a bottom support structure. The bottom support structure provides a spring support area constructed to withstand a greater vertical down force at predetermined locations thereon than at other locations. In addition, a plurality of spring members extend between the grid top and the bottom support structure. A fabric cover is provided to enclose said grid top and said spring members. Padding material of generally equal dimensions as the grid top may be provided, lying flat between the grid top and the fabric cover.

In some exemplary embodiments, the bottom support structure includes a plurality of first cross slats and a plurality of second cross slats. The second cross slats are capable of withstanding a greater vertical down force than the first cross slats. For example, each second cross slat may be a wooden beam with unequal vertical and horizontal dimensions placed so that its greater dimension side is extending vertically from the plane of the bottom support structure.

The grid top may comprise a plurality of first metal ribs spaced a predetermined distance apart and extending transverse to a longitudinal direction of the bottom support structure. A plurality of second metal ribs are also provided, spaced a predetermined distance apart and extending perpendicular to the first metal ribs. At least one of the first metal ribs is preferably positioned above each of the first cross slats along a vertical plane.

The accompanying drawings, which are incorporated in and constitute a part of this specification, illustrate two exemplary embodiments of the invention and, together with the description, serve to explain the principles of the invention.

BRIEF DESCRIPTION OF THE DRAWINGS

A full and enabling disclosure of the present invention, including the best mode thereof and directed to one of ordinary skill in the art, is set forth in the specification, which makes reference to the appended drawings, in which.

Figure 1:
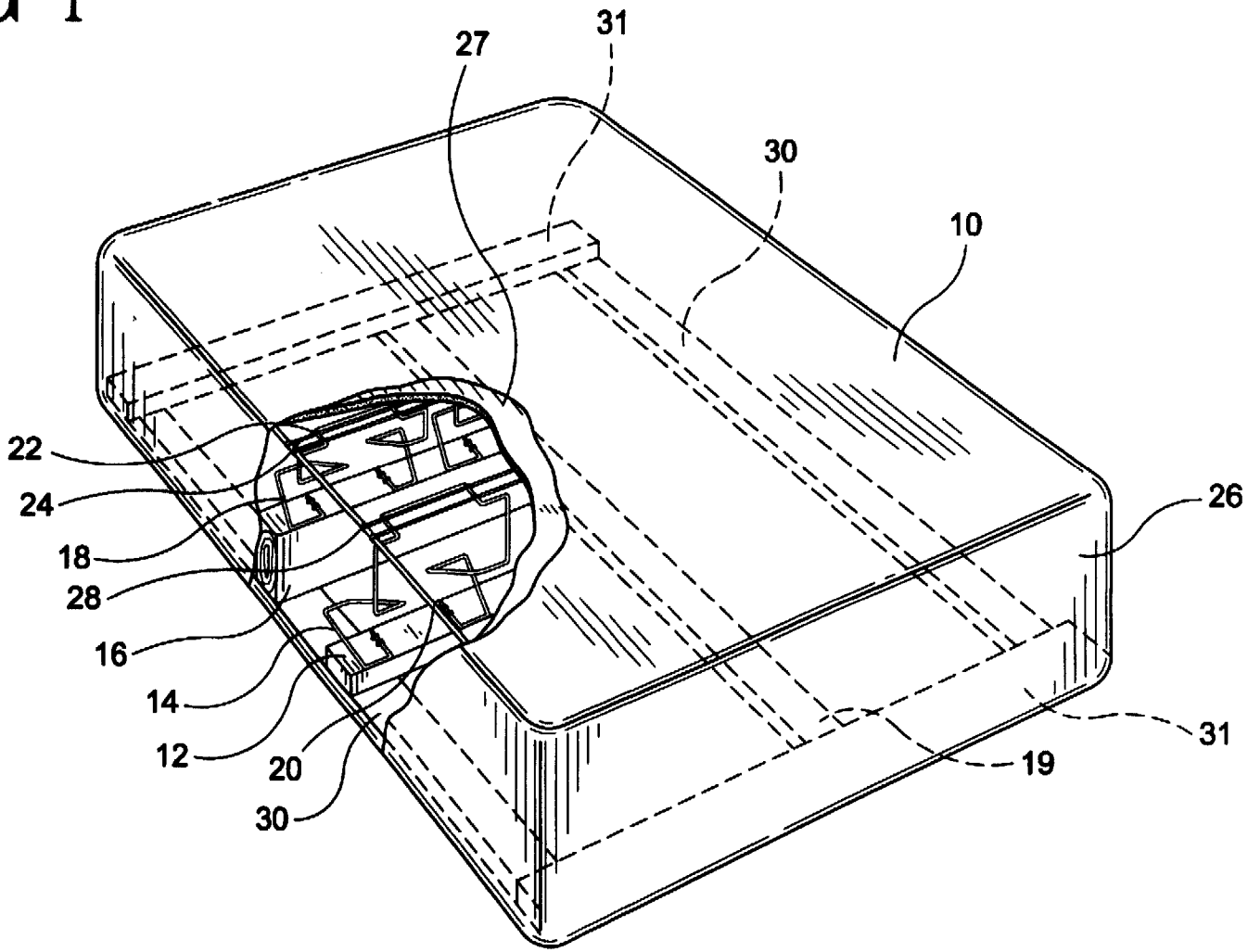
FIG. 1 is a cut-away perspective view of a box spring assembly constructed in accordance with the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is concerned with an improved design for the construction of a box spring assembly. Accordingly, FIG. 1 depicts a box spring assembly 10 constructed in accordance with the present invention. Box spring assembly 10 has a rectangular frame foundation with a pair of parallel side rails 30 and a pair of parallel end rails 31 located at the respective ends of side rails 30. Box spring assembly 10 uses a combination of flat cross slats 12 supporting conventional spring modules 14 and reinforcing cross slats 16 supporting low profile spring modules 18. The cross slats are positioned such that each end lies on top of a respective side rail 30. One or more center rails 19 may also be provided, extending longitudinally along the major axis of box spring assembly 10 as shown. Conventionally, the various rails and cross slats of the frame foundation may be constructed of wood.

Box spring assembly 10 may enclosed by a suitable fabric cover 26 in a conventional manner. The fabric cover may extend at least over the tops and-sides of box spring assembly 10. Padding 27 may be provided extending under fabric cover 26 on the top of box spring assembly 26, as shown.

Spring modules 14 are 18 are preferably attached to a grid top 20 using suitable attachment means 22, such as interconnecting wires or clamps. Grid top 20 is shown in FIG. 1 to have a rectangular metal boundary 28 to which metal ribs 24 are attached, running parallel to the end rails of the underlying frame. Grid top 20 may also have metal ribs running perpendicular to the end rails.

Figure 2A:
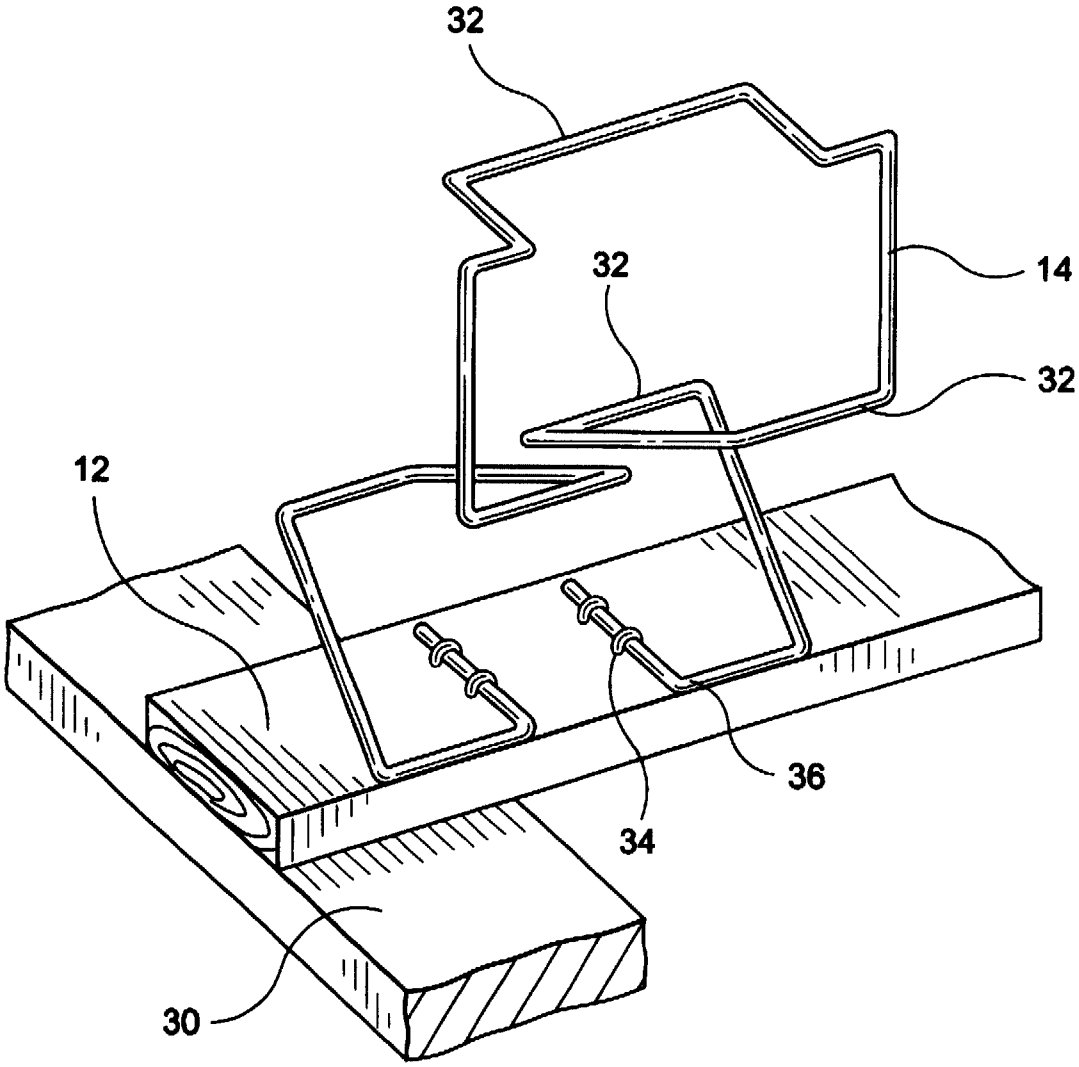
FIGS. 2A and 2B are fragmentary perspective views of respective portions of the box spring assembly illustrated in FIG. 1.
Figure 2B:
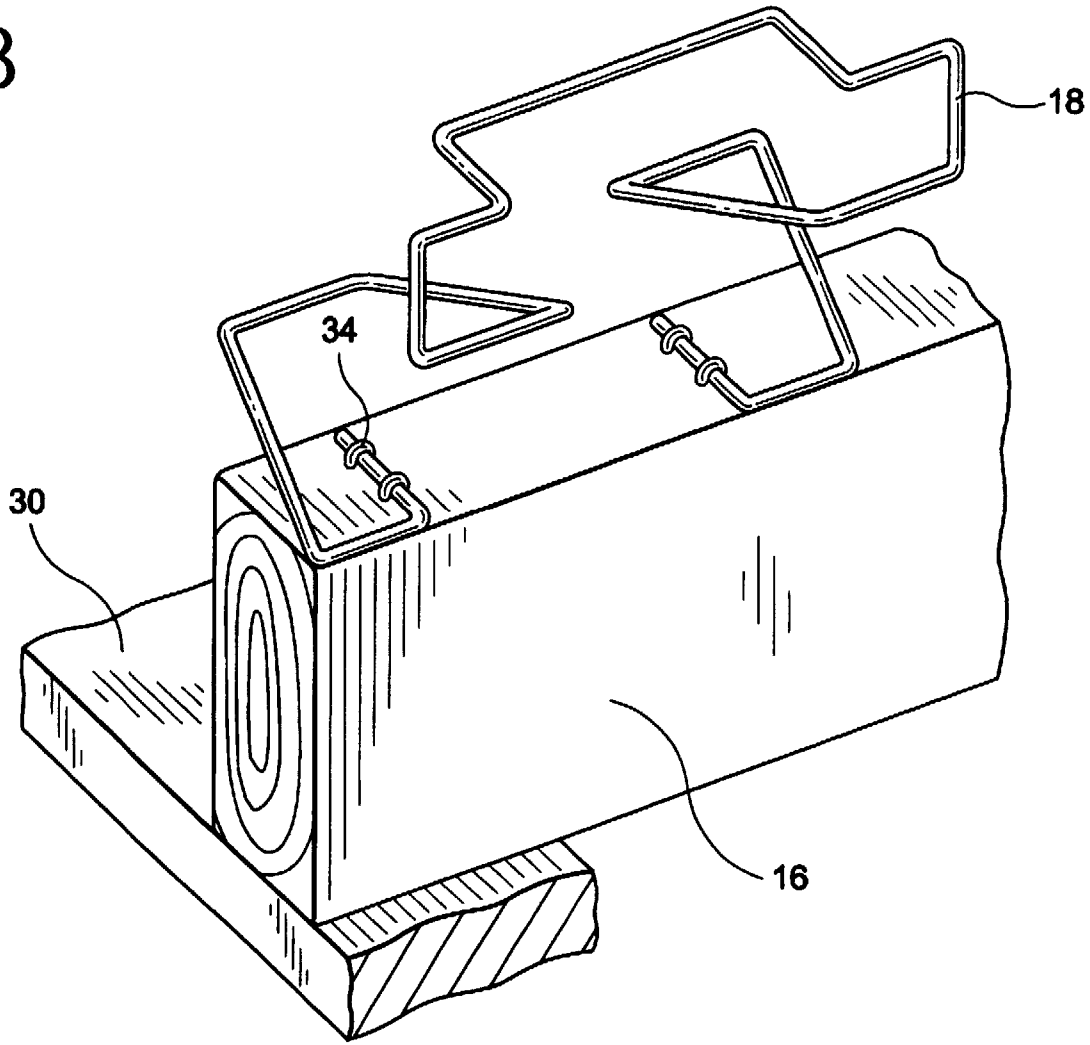

The manner in which spring modules 14 and 18 are mounted is depicted in greater detail in FIGS. 2A and 2B, respectively. The conventional cross slat 12 in FIG. 2A and the reinforcing cross slat 16 in FIG. 2B are supported at each end by a respective side rail 30. Suitable means, such as adhesive or nails, are utilized to secure the end of slats 12 and 16 to rail 30 in this location.

Cross slat 12 may be an oblong wooden beam, such as a one-by-two or one-by-three, positioned so that its side with the greater dimension lies across the side rail 30. Spring module 14 has a conventional vertical height and comprises three torsion bars 32. The bottom leg 36 of spring module 14 is attached to cross slat 12 using suitable means, such as staples 34.

Because of its low profile, spring module 18, also depicted as a three bar torsion spring, has a vertical height less than the vertical height of spring module 14. Like spring module 14, spring module 18 is attached to using suitable means, such as staples 34. Reinforcing cross slat 16 is configured in this case as a wooden beam rectangular in cross section, such as a two-by-four, and mounted on edge. This combination of cross slat 16 and spring module 18 will have the same vertical height as the combination of conventional spring module 14 atop conventional cross slat 12.

Both types of spring modules 14 and 18 are depicted in FIG. 1 as torsion springs. It will be appreciated that other suitable spring configurations, such as helical springs, may also be utilized for this purpose.

Figure 3:
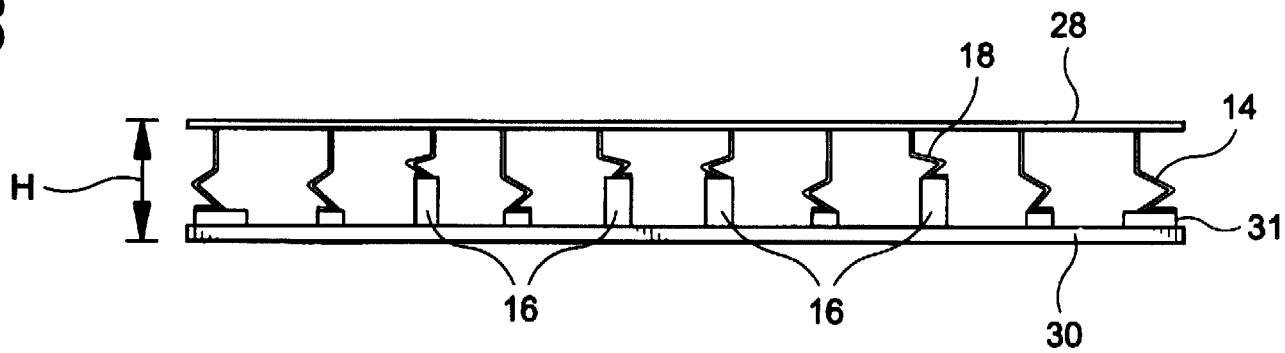
FIG. 3 is a diagrammatic view in side elevation of one embodiment of the box spring assembly illustrated in FIG. 1.
Figure 4:
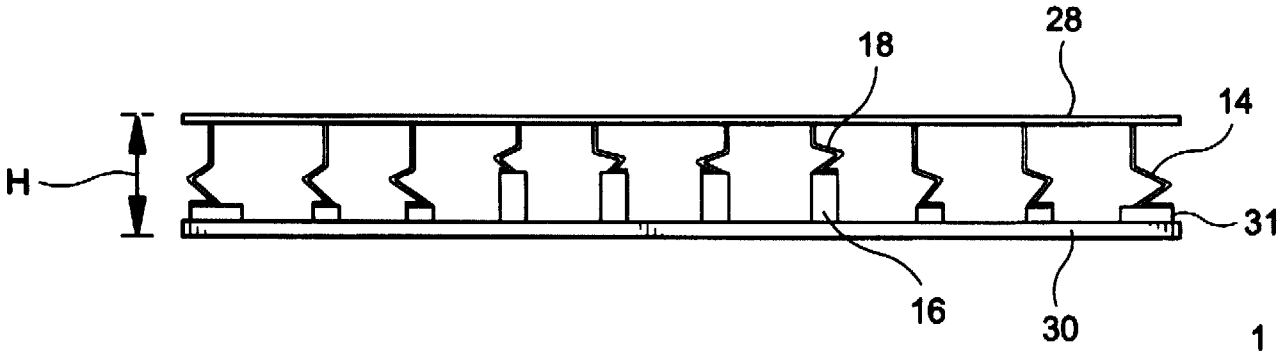
FIG. 4 is a diagrammatic view in side elevation of another embodiment of the box spring assembly illustrated in FIG. 1.
Figure 5:
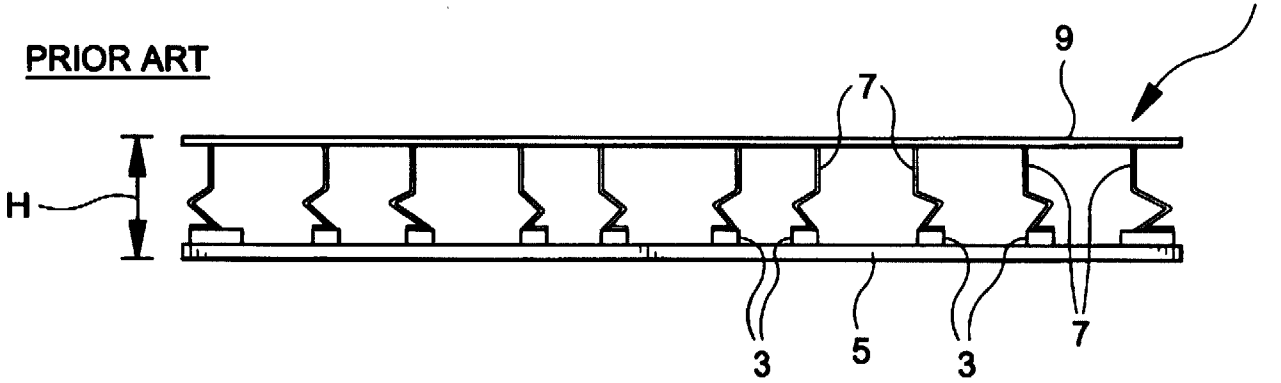
FIG-5 PRIOR ART
FIG. 5 is a view similar to FIG. 3 and 4 of a box spring assembly design shown in prior art.

FIGS. 3 and 4 illustrate the use of the combination of reinforcing cross slats and low profile spring modules with conventional cross slats and conventional spring modules in two preferred embodiments of the present invention. Both embodiments show the use of the reinforcing cross slats with and low profile spring members only at selected positions in the box spring assembly.

The design illustrated by FIG. 3 positions reinforcing cross slats 16 under the user's shoulders, buttocks, hips, and legs. Thus, the box spring and the overlying mattress are strengthened at these important pressure points. As a result, sagging which could otherwise occur through failure of conventional cross slats is reduced. FIG. 4 shows a different configuration with reinforcing cross slats 16 concentrated in the center of the box spring assembly. This design provides extra support along the user's entire torso.

As illustrated in FIGS. 3 and 4, the box spring is constructed using conventional cross slats in the areas of the box spring assembly in which extra strength is not needed. As such, sagging that could otherwise occur in a conventional box spring is reduced. In addition, weight and cost are reduced in comparison to a box spring assembly using reinforcing cross slats throughout.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

What is claimed:

1. A box spring assembly having a predetermined vertical height, said box spring assembly comprising:

a rectangular bottom frame including a pair of parallel side rails, and a pair of parallel end rails respectively positioned at the opposite ends of said side rails;

a series of cross slats supported by said side rails positioned between and parallel to said end rails a predetermined distance apart, said cross slats including a plurality of first cross slats having a first height, and a plurality of second cross slats having a second height greater than said first height;

a plurality of first spring members mounted on each of said first cross slats, said first spring members having a third height generally complementary to said first height to provide said predetermined vertical height; and a plurality of second spring members, mounted on each of said second cross slats, said second spring members having a fourth height generally complementary to said second height to provide said predetermined vertical height.

2. A box spring assembly as in claim 1, wherein at least two of said second cross slats are located in two innermost adjacent positions on said bottom frame.

3. A box spring assembly as in claim 2, wherein four of said second cross slats are located in four innermost adjacent positions on said bottom frame and said first cross slats are located in remaining positions on said bottom frame.

4. A box spring assembly as in claim 2, wherein one additional said second cross slat is located on each side of said two of said second cross slats in a position separated therefrom by one said first cross slat.

5. A box spring assembly as in claim 1, further including a grid top, each of said first spring members and each of said second spring members being attached to said grid top.

6. A box spring assembly as in claim 1 wherein each said spring member is attached to one said cross slat using securement means.

7. A box spring assembly as in claim 1 wherein said spring members are torsion springs.

8. A box spring assembly as in claim 1 including at least one center slat extending below said cross slats, said center slat being located between and generally parallel to said side rails.

* * * * *